US007019317B1

(12) United States Patent
Martin et al.

(10) Patent No.: US 7,019,317 B1
(45) Date of Patent: Mar. 28, 2006

(54) RADIOPHARMACEUTICAL SHIPPING PIG WITH ENCAPSULATED LEAD SHIELDING

(75) Inventors: Matthew R. Martin, Remsenberg, NY (US); Kenneth A. Paladino, Mastic Beach, NY (US)

(73) Assignee: Biodex Medical Systems, Inc., Shirley, NY (US)

( * ) Notice: Subject to any disclaimer, the term of this patent is extended or adjusted under 35 U.S.C. 154(b) by 0 days.

(21) Appl. No.: 10/963,702

(22) Filed: Oct. 13, 2004

Related U.S. Application Data

(63) Continuation-in-part of application No. 10/434,796, filed on May 9, 2003, now Pat. No. 6,822,253.

(51) Int. Cl.
*G21F 5/00* (2006.01)
*G21F 5/002* (2006.01)
*G21F 5/005* (2006.01)

(52) U.S. Cl. ..... 250/506.1; 250/507.1; 250/515.1

(58) Field of Classification Search ..... 250/505.1, 250/506.1, 507.1, 515.1; 206/364, 524.1; 53/449, 485; 220/23.87; 604/198; 29/426.5, 29/469, 426.3
See application file for complete search history.

(56) References Cited

U.S. PATENT DOCUMENTS

| | | | |
|---|---|---|---|
| 2,682,352 | A | 6/1954 | Hawkins et al. |
| 2,812,231 | A | 11/1957 | Zar |
| 3,074,542 | A | 1/1963 | Myerson et al. |
| 3,101,841 | A | 8/1963 | Baldwin |
| 3,149,717 | A | 9/1964 | Castelli |
| 3,272,322 | A | 9/1966 | Ogle |
| 3,294,231 | A | 12/1966 | Vanderbeck |
| D208,080 | S | 7/1967 | Hamilton |
| 3,329,146 | A | 7/1967 | Waldman, Jr. |
| 3,344,787 | A | 10/1967 | Maclean |
| 3,367,488 | A | 2/1968 | Hamilton |
| 3,531,644 | A | 9/1970 | Koster |
| 3,673,411 | A | 6/1972 | Glasser |
| 3,677,247 | A | 7/1972 | Brown |
| 3,882,315 | A | 5/1975 | Soldan |
| 3,971,955 | A | 7/1976 | Heyer et al. |
| 3,993,063 | A | 11/1976 | Larrabee |
| 4,081,688 | A | 3/1978 | Fries |
| 4,106,622 | A | 8/1978 | Windischman |
| 4,113,090 | A | 9/1978 | Carstens |
| 4,357,541 | A | 11/1982 | Ernst |

(Continued)

OTHER PUBLICATIONS

U.S. Department of Labor Weighs printout, "Clarification of OSHA" Bloodborne Pathogens Standard as it relates to syringes and needles contaminated with both a bloodborne pathogen and radioactive nuclear medicine. Standard No. 1910.1030, Oct. 29, 1996.

(Continued)

*Primary Examiner*—Frank G. Font
*Assistant Examiner*—Mary El-Shammaa
(74) *Attorney, Agent, or Firm*—Gibbons, Del Deo, Dolan, Griffinger & Vecchione

(57) ABSTRACT

Encapsulation of an inner facing surface of a lead shield of a radiopharmaceutical pig. The inner facing surface defines a chamber in which is inserted a radiopharmaceutical syringe. The encapsulation protects the inner facing surface against contamination due to leaks of the contents of the radiopharmaceutical syringe and further obviates the need for a sharps container to enclose the syringe during transport. The outer facing surface may likewise be encapsulated and secured to the encapsulation of the inner facing surface.

19 Claims, 8 Drawing Sheets

U.S. PATENT DOCUMENTS

| | | | | |
|---|---|---|---|---|
| 4,781,697 | A | | 11/1988 | Slaughter |
| 4,846,235 | A | | 7/1989 | Handke |
| 4,851,702 | A | | 7/1989 | Perlman |
| 4,869,299 | A | | 9/1989 | Handke |
| 4,892,525 | A | | 1/1990 | Hermann, Jr. et al. |
| 4,917,263 | A | | 4/1990 | Korb |
| D324,101 | S | | 2/1992 | Reif et al. |
| 5,096,062 | A | | 3/1992 | Burkardt et al. |
| 5,099,998 | A | | 3/1992 | Curzon et al. |
| 5,145,063 | A | | 9/1992 | Lee |
| 5,157,900 | A | | 10/1992 | Kupersmit |
| D333,347 | S | | 2/1993 | Kemp et al. |
| 5,205,408 | A | | 4/1993 | Cobb |
| 5,235,795 | A | | 8/1993 | DeBusk |
| 5,245,117 | A | | 9/1993 | Withers et al. |
| 5,277,312 | A | | 1/1994 | Vumbaca |
| 5,303,836 | A | | 4/1994 | Childress |
| 5,323,719 | A | | 6/1994 | Withers et al. |
| 5,385,105 | A | | 1/1995 | Withers, Jr. et al. |
| 5,417,326 | A | | 5/1995 | Winer |
| 5,519,931 | A | | 5/1996 | Reich |
| 5,536,945 | A | | 7/1996 | Reich |
| 5,552,612 | A | | 9/1996 | Katayama et al. |
| 5,611,429 | A | | 3/1997 | Phillips |
| 5,672,883 | A | | 9/1997 | Reich |
| 5,828,073 | A | | 10/1998 | Zhu et al. |
| 5,834,788 | A | | 11/1998 | Fu et al. |
| D405,609 | S | | 2/1999 | Fu et al. |
| 5,918,443 | A | | 7/1999 | Phillips |
| 5,927,351 | A | | 7/1999 | Zhu et al. |
| RE36,693 | E | | 5/2000 | Reich |
| D425,197 | S | | 5/2000 | Comer et al. |
| 6,162,198 | A | * | 12/2000 | Coffey et al. ..... 604/198 |
| D447,231 | S | | 8/2001 | Chen Fu et al. |
| 6,425,174 | B1 | | 7/2002 | Reich |
| 6,576,918 | B1 | * | 6/2003 | Fu et al. ..... 250/507.1 |
| 6,586,758 | B1 | * | 7/2003 | Martin ..... 250/515.1 |
| 6,722,499 | B1 | | 4/2004 | Reich |
| 2002/0178566 | A1 | * | 12/2002 | Reich ..... 29/426.5 |
| 2002/0195575 | A1 | * | 12/2002 | Martin ..... 250/506.1 |
| 2003/0146399 | A1 | | 8/2003 | Martin et al. |
| 2003/0222228 | A1 | * | 12/2003 | Fu et al. ..... 250/507.1 |

OTHER PUBLICATIONS

U.S. Department of Labor Weighs printout, "Unit dose syringes", Standard No. 1910.1030, Aug. 25, 1993.

Cardinal Health Inc., article entitled "Solutions for the safer handling of radiopharmaceuticals" Copyright Apr. 2004.

* cited by examiner

RADIOPHARMACEUTICAL SHIPPING PIG WITH ENCAPSULATED LEAD SHIELDING

REFERENCE TO PRIOR APPLICATION

This application is a continuation-in-part of U.S. patent application Ser. No. 10/434,796 filed May 9, 2003.

BACKGROUND OF THE INVENTION

1. Field of the Invention

The present invention relates to shipping pigs for radiopharmaceuticals that use lead for radiation shielding. In particular, lead shielding is encapsulated and sealed.

2. Discussion of the Prior Art

Conventional shipping pigs for radiopharmaceuticals include those that use lead for radiation shielding. The lead shielding defines a cavity to accommodate the syringe. Some conventional pigs have a removable, puncture proof, inner liner or a removable sharps container positioned within their cavity to serve as a barrier between the radiopharmaceutical syringe and the lead shielding. Such a barrier prevents contamination of the lead shielding by leaks from the radiopharmaceutical syringe, such leaks are contained by the inner liner or sharps container. A sharps container is known conventionally to be made from a puncture resistant, if not puncture-proof, hard plastic material having a tubular housing that is securable to a tubular cap in a releasable manner. Both the tubular housing and the tubular cap of the sharps container are elongated with their distal ends (to each other) closed and their proximal ends (to each other) open. The sharps container is sized to accommodate inside a syringe.

It would be desirable to provide a radiopharmaceutical pig that encapsulates and seals lead shielding without the need for a removable, puncture-proof liner or a sharps container to protect the lead shielding from contamination caused by leaks from the radiopharmaceutical syringe.

SUMMARY OF THE INVENTION

One aspect of the invention resides in encapsulation of an inner facing surface of a lead shield of a radiopharmaceutical pig. The inner facing surface defines a chamber in which is inserted a radiopharmaceutical syringe. The encapsulation protects the inner facing surface against contamination from leaks of the contents of the radiopharmaceutical syringe and further obviates the need for a sharps container to enclose the syringe. If desired, a non-puncture resistant, disposable housing may be inserted into the lower portion of the chamber so that the lower portion of the radiopharmaceutical syringe (with the needle) may be inserted into a cavity of the housing, thereby also doing away with the need for a sharps container. The cavity of the housing catches any leaks from the syringe that may occur to prevent the leaks from reaching regions outside the housing that the leaks could otherwise contaminate.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE DRAWING

Figure 1:
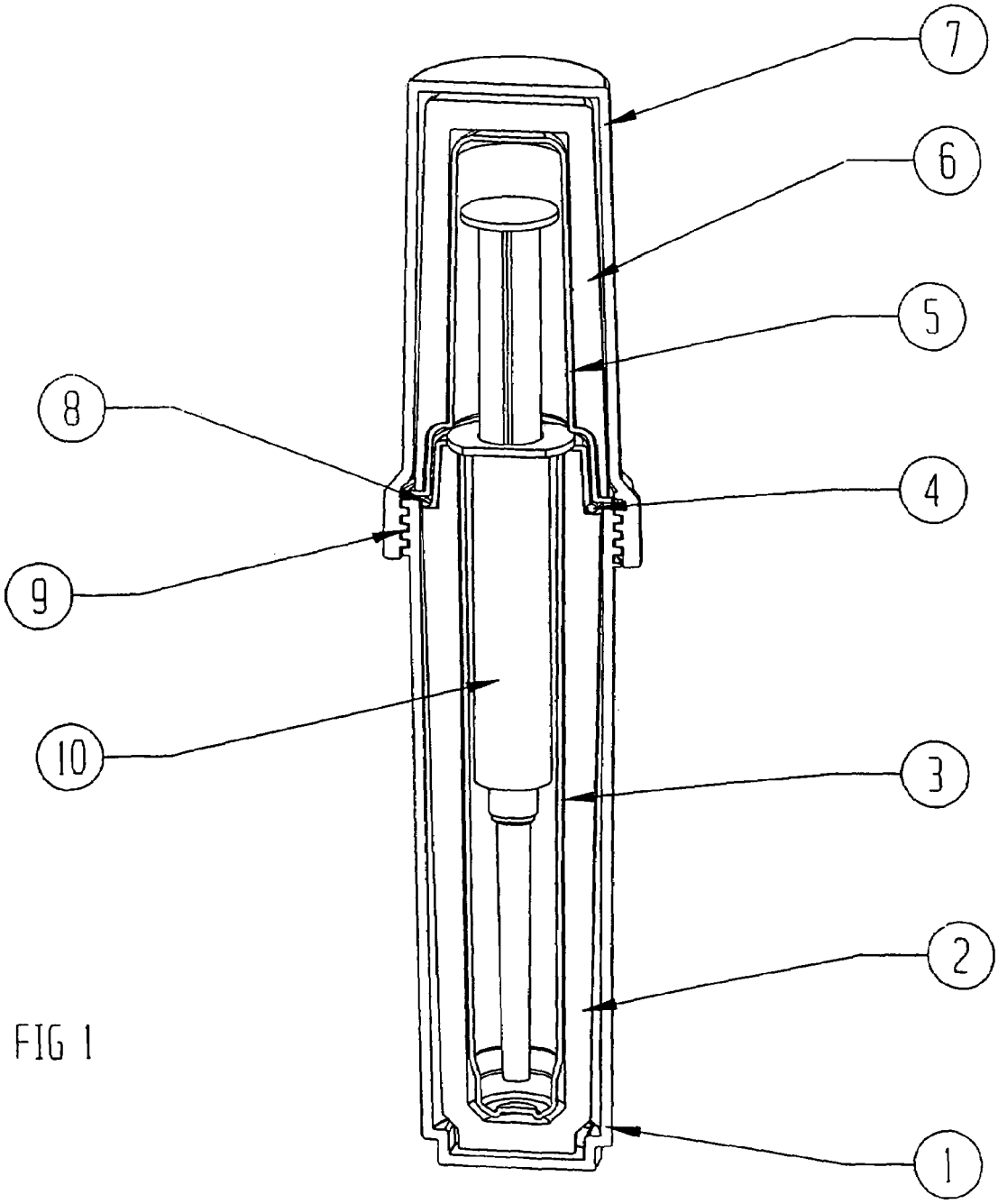
FIG. 1 shows a longitudinal cutaway view of a radiopharmaceutical pig in accordance with the invention.
Figure 2:
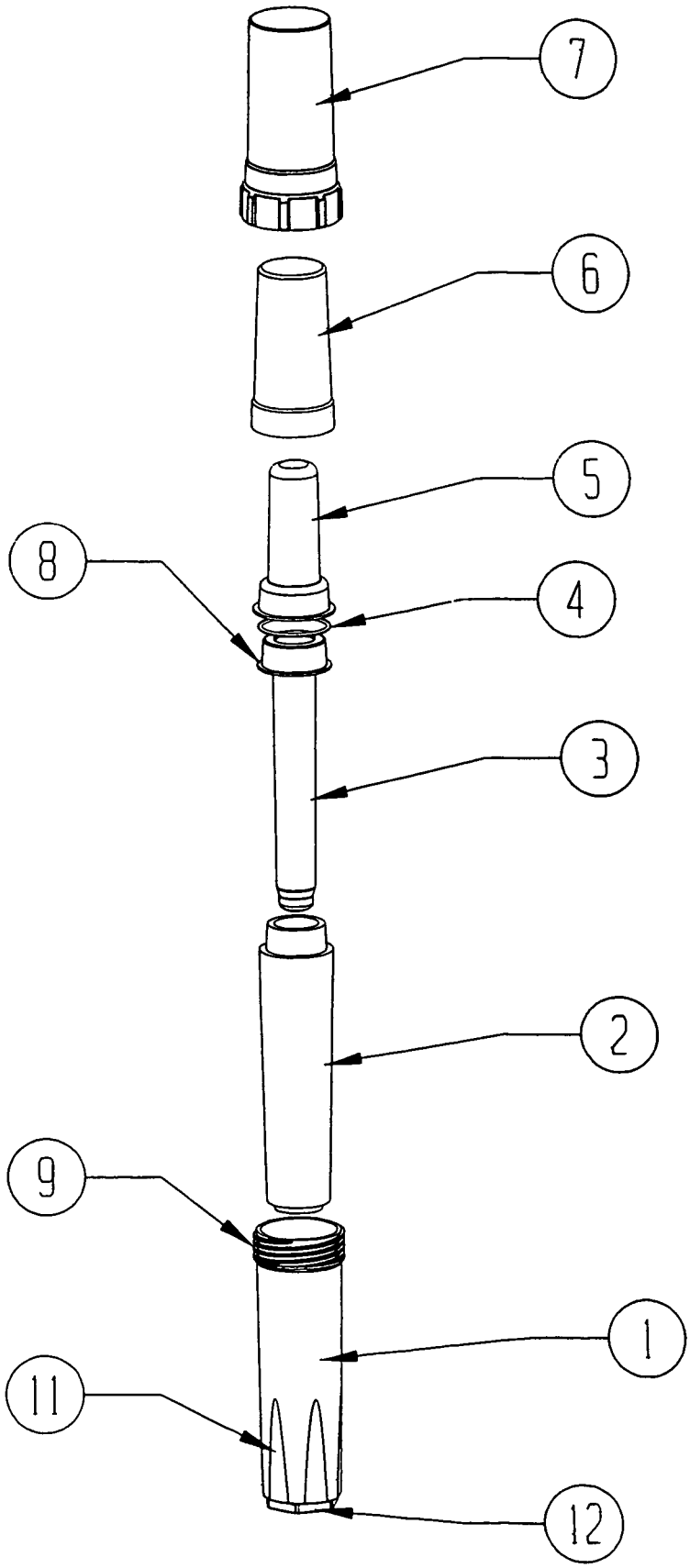
FIG. 2 is an exploded view thereof.
Figure 3:
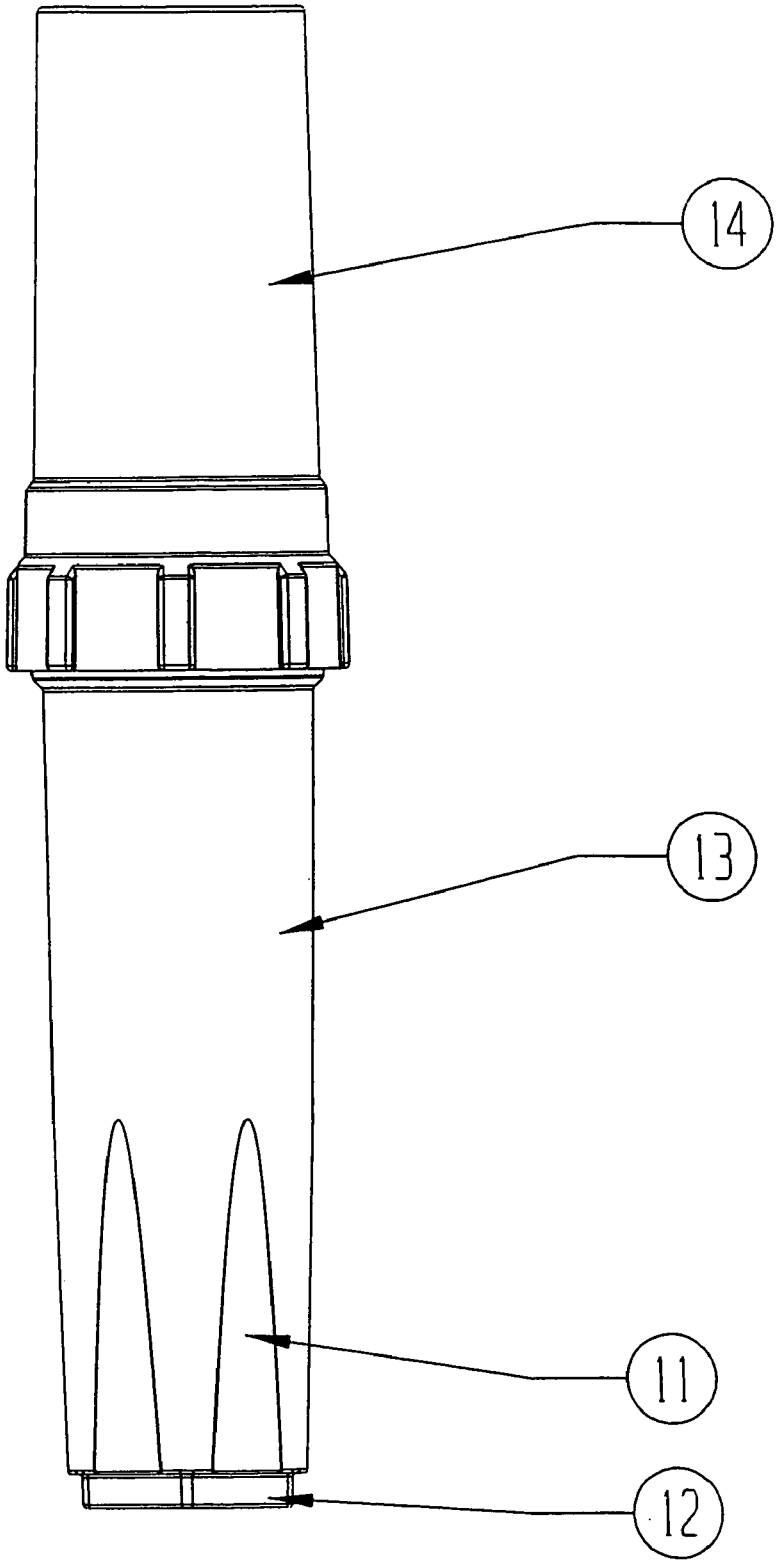
FIG. 3 is an elevation side view thereof.

Turning to the drawings, FIGS. 1 and 2 identify lower assembly components, namely, a lower case 1, a lower lead shield 2, a lower liner 3, and an O-ring 4, all which may be collectively considered part of a lower assembly 13. FIGS. 1 and 2 also identify upper assembly components, namely, an upper lead shield 6, an upper liner 5 and an upper case 7, all which may collectively be considered part of an upper assembly 14.

The lower case 1, upper case 7, lower liner 3 and the upper liner 5 may be made of plastic, metal or a combination of each. The lower case 1 and the lower liner 3 may be secured to the lead shield so that together they encapsulate and seal the lower lead shield 2. Alternatively, the lower case 1 and the lower liner 3 may be secured to each other to contain the lower lead shield 2, but without being secured to the lower lead shield 2 itself. In either situation, the lower case 1 and lower liner 3 may be made contiguous with each other and formed from the same material, as opposed to being separate components.

Likewise, the upper case 7 and the upper liner 5 may be secured to the lead shield so that together they encapsulate and seal the upper lead shield 6. Alternatively, the upper case 7 and the upper liner 5 may be secured to each other to contain the upper lead shield 6, but without being secured to the upper lead shield 6 itself. In either situation, the upper case 7 and upper liner 5 may be made contiguous with each other and formed from the same material, as opposed to being separate components.

To secure the lower case 1 to the lower liner 3 and/or to the lower lead shield 2 as applicable, and to secure the upper case 7 to the upper liner 5 and/or to the upper lead shield 6, as applicable, either a securing material 15, 16 (FIGS. 4–5) or mechanical fit components 17, 18 (FIGS. 6–7) may be employed. The securing material 15, 16 (FIGS. 4–5) may be an ultrasonic seal, a heat seal, adhering material, and/or laminating material or any combination of these. The mechanical fit components 17, 18 (FIGS. 6–7) may be pressure snap rings or other types of pressure fit components, such as screw locks, clamps or conventional mechanical fasteners.

The O-ring 4, which may be made of neoprene or other elastomer, is securely attached into a groove 8, such as with glue or epoxy. The O-ring 4 seals the lower liner 3 to the upper liner 5 as the upper assembly 14 may be screwed onto the lower assembly 13 using the threads 9. Each of the lower liner 3 and the upper liner 5 may have outwardly directed flange surfaces that sandwich the O-ring 4 between them to seal a chamber defined by the lower and upper liners 3, 5.

The threads 9 may be triple start threaded to reduce an amount of turns needed to screw the two assemblies 13, 14 together.

In addition, the lower case 1 has flats 11 that are molded to prevent the lower assembly 13 from rolling on a flat surface. There may be a configuration with at least one corner such as a hexagon shape 12 molded onto the bottom of the lower case 1 such that the hexagon shape 12 can be secured in a hexagon shaped hole or recess. This way the upper assembly 14 can be screwed to, or unscrewed from, the lower assembly 13 without the user holding onto the lower assembly. This greatly reduces the amount and duration of hand exposure to radiation, because the user no longer needs to hold onto the lower assembly during the screwing and unscrewing operations.

The syringe 10 contains a radiopharmaceutical and is placed into the lower liner 3 before the two halves of the upper and lower cases 1, 7 are screwed together by engaging thread connections. After the two halves have been screwed together, the syringe 10 is shipped filled within the two halves to a site. After arrival at the site, the syringe is removed from the two halves and used to administer the radiopharmaceutical from the syringe. When done, the empty syringe may be reinserted into the pig and then shipped back to the supplier for further handling. Otherwise, the empty syringe may be placed into a conventional, lead shielded container (not shown) for future disposal in accordance with government regulations for safe disposal of spent radiopharmaceutical syringes.

The two lead shields 2, 6 have edges that face each other that are configured to overlap and engage each other so as to completely shield against penetration of radiation at the joint between the two lead shields 2, 6. Thus, lower lead shield 2 may have a tubular projection in the edge that complements a further tubular projection in the edge of the upper lead shield 6 and is of a reduced diameter relative to that of the further tubular projection. The lower lead shield 2 may have a lower projection that fits within a complementary recess inside at the base of the lower case 1.

As a result of encapsulating, the lower and upper lead shields 2, 6 are sealed and thereby protected by the lower and upper liners 3, 5 against contamination from any radiopharmaceutical remnants from the syringe 10 and against exposing the lead shields to cleansing fluids such as water when cleaning them.

The syringe 10 may be entirely free of any sharps container surrounding it, because the lower and upper liners 3, 5 obviate the need for it. Indeed, a sharps container would not need to be used in the radiopharmaceutical pig of the present invention to provide sufficient protection of the lead shields against contamination by the discharge of any remnants from within the syringe 10, because the encapsulation provides sufficient protection. The lower and upper liners 3, 5 themselves may be formed of an encapsulating material that adheres or otherwise clings to secure itself to the lead shield to which it is in contact, such as when subjected to a sufficient amount of heat.

Figure 4:
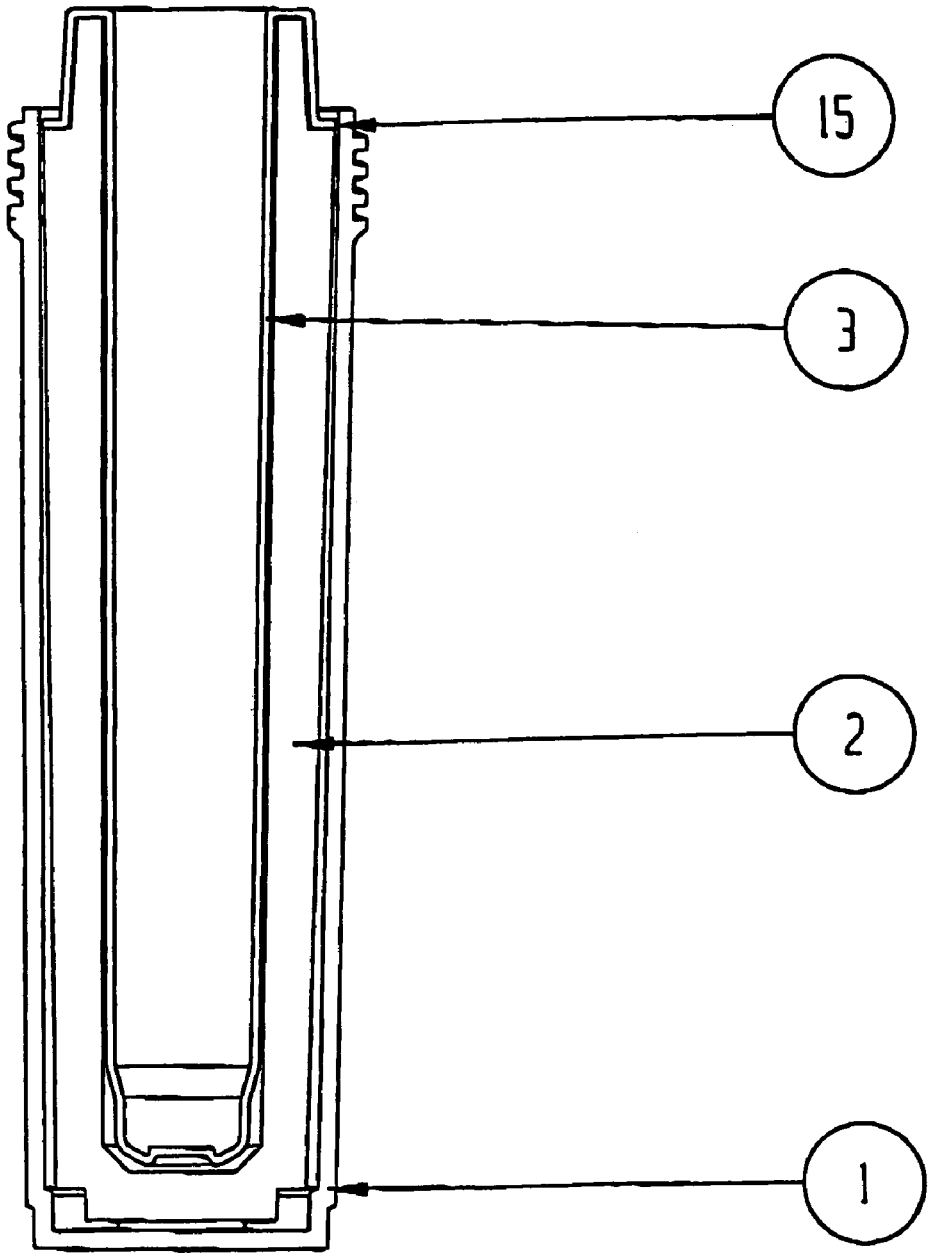
FIG. 4 is a longitudinal cutaway of the lower assembly of the radiopharmaceutical pig of FIG. 1.
Figure 5:
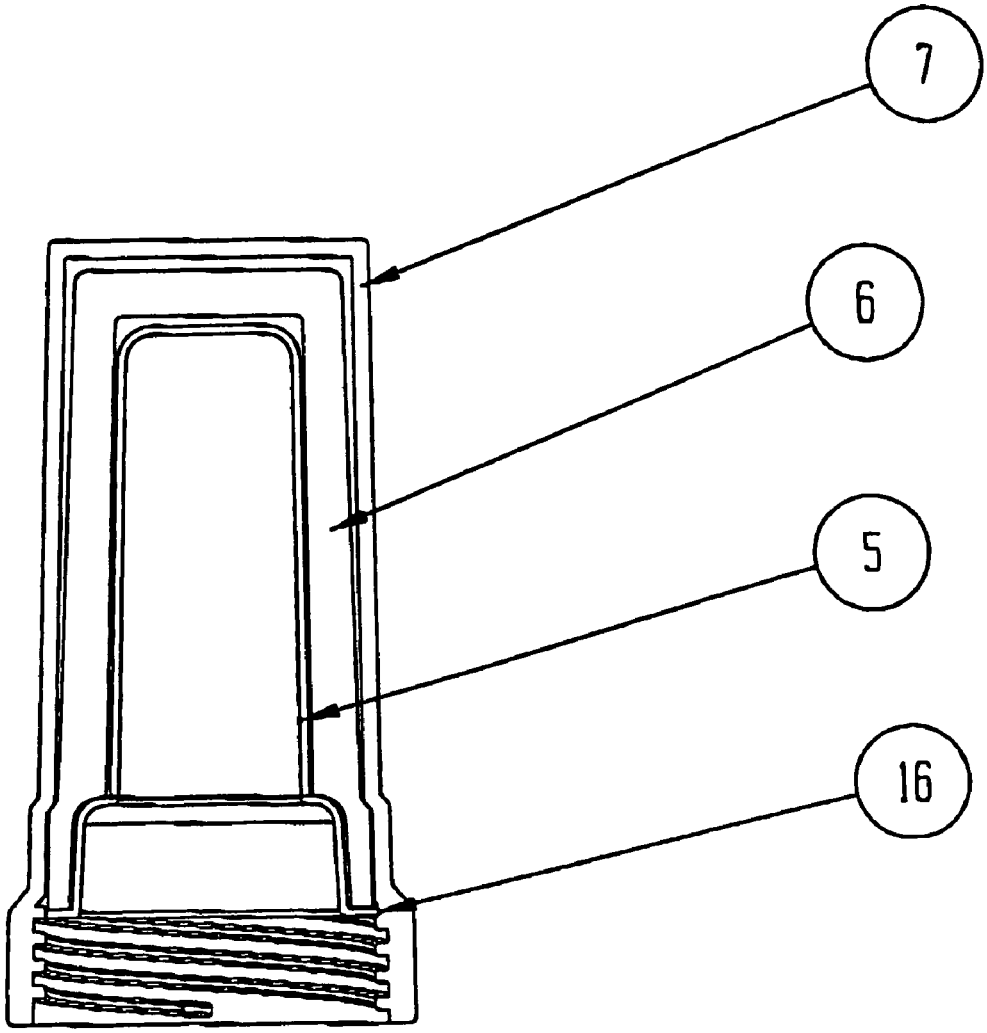
FIG. 5 is a longitudinal cutaway of the upper assembly of the radiopharmaceutical pig of FIG. 1.

Turning to FIGS. 4 and 5, the lower shield 2 does not have to be secured to either the lower case 1 or to the lower liner 3. Instead, the lower liner 3 is secured directly to the outer case 1 around a periphery (contact diameter) with the securing material 15. Likewise, the upper shield 6 does not have be secured to either the upper case 7 or to the upper liner 5. Instead, the upper liner 5 may be secured to the upper case 7 about a periphery (contact diameter) with the securing material 16. The lower shield 2 and the upper shield 6 are thereby held in place.

Figure 6:
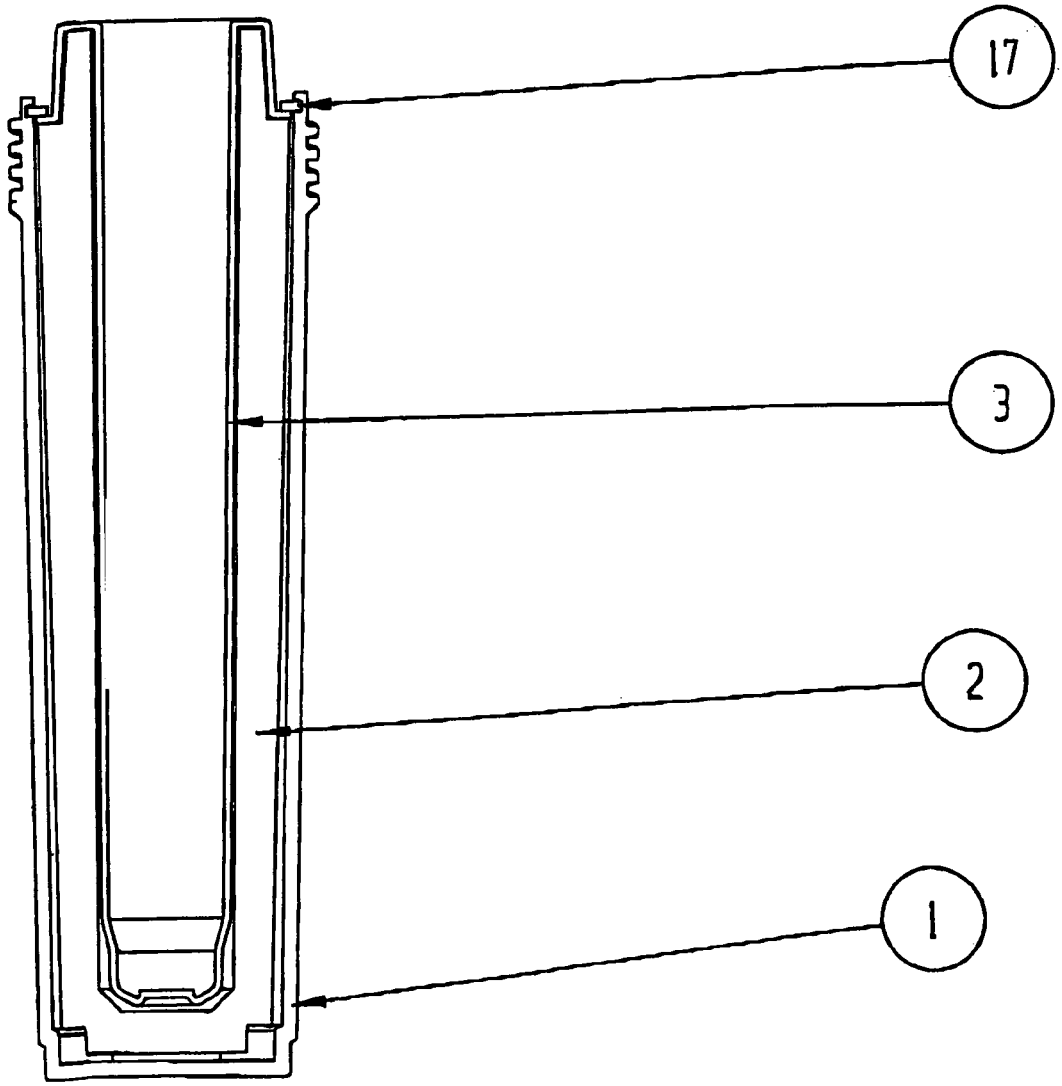
FIG. 6 is a longitudinal cutaway of the lower assembly of the radiopharmaceutical pig in accordance with a further embodiment.
Figure 7:
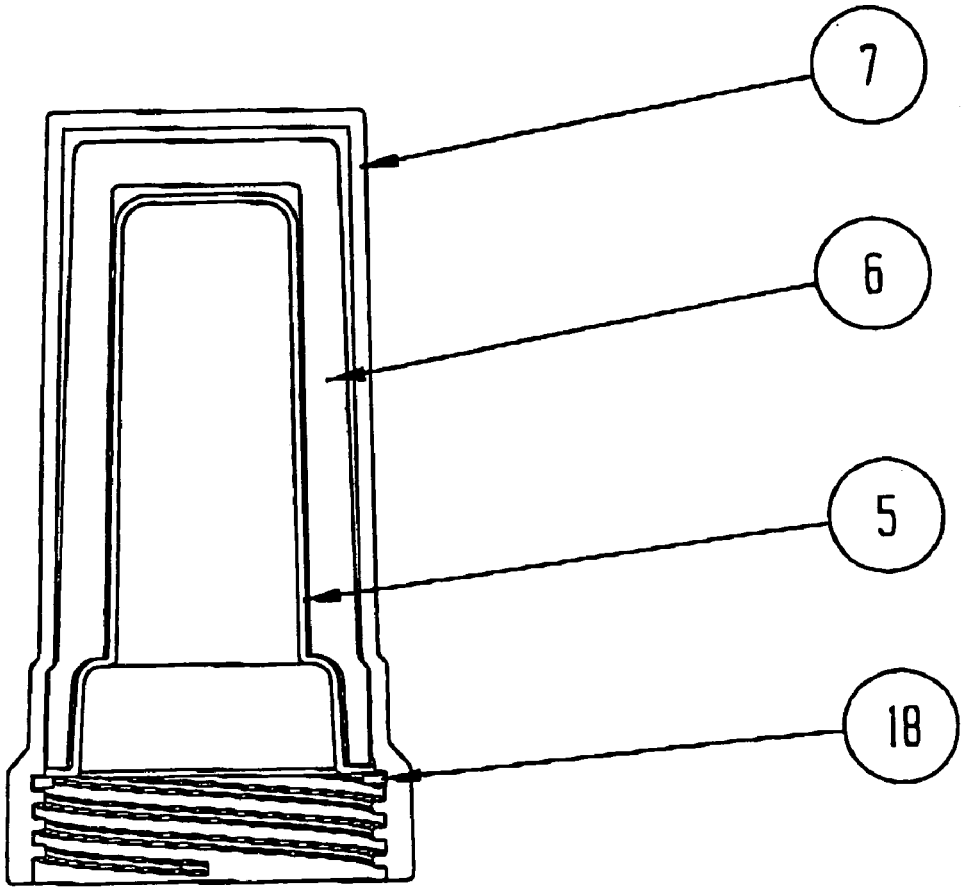
FIG. 7 is a longitudinal cutaway of the upper assembly of the radiopharmaceutical pig in accordance with the further embodiment.

Turning to FIGS. 6 and 7, the lower liner 3 may be mechanically fastened to the lower case 1 using a mechanical fit component 17, such as snap rings, screw locks, clamps or conventional mechanical fasteners. The lead shield 2 need not be adhered to anything. Likewise, the upper liner 5 is mechanically fastened to the upper case 7 using a mechanical fit component 18, such as snap rings, screw locks, clamps or conventional mechanical fasteners. The lead shield 6 need not be adhered to anything.

Figure 8:
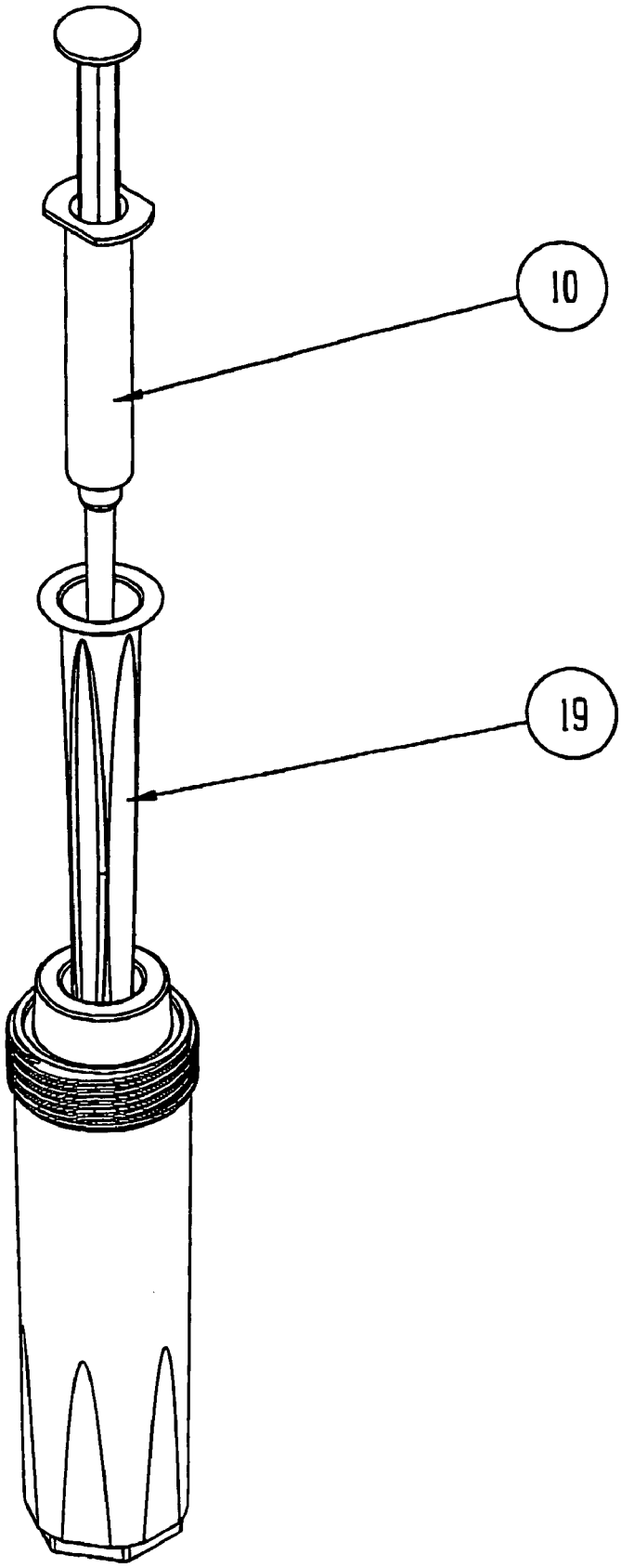
FIG. 8 is an isometric view of the lower assembly of the radiopharmaceutical pig in accordance with another embodiment.

Turning to FIG. 8, a flexible, removable, disposable housing 19 is shown for the lower half of the pig. The housing 19 is not puncture-resistant, but would still serve to keep the pig clean, capturing anything that may come out of the syringe 10, because the housing 19 has a closed bottom end. The housing 19 is positioned to be out of contact with the tip of the needle of the syringe while the syringe is within the pig. The housing 19 may be made of any non-puncture-resistant material, such as a soft plastic.

In accordance with the invention, sufficient clearance is provided within the cavity defined by the housing to accommodate insertion of the syringe so that the tip of the needle of the syringe will not contact the housing during insertion of same into the lower portion of the cavity and by configuring the upper and lower halves of the radiopharmaceutical pig to clamp outward flanges of the syringe between them so as to maintain the position of the syringe within the cavity in a stable manner during transport.

Preferably, the clearance within the lower portion of the cavity is longer than the tip of the needle can reach when the lower portion of the syringe is fully inserted and is wider than the diameter of the body of the syringe and thus many times wider than the diameter of the needle.

The housing 19 is elongated with a mouth at one end sized to accommodate insertion of the needle of the radiopharmaceutical syringe through the mouth and preferably accommodate the lower half of the syringe, and an opposite end that is closed to contain any leaks from the radiopharmaceutical syringe. If desired, a puncture resistant platform (not shown) may be inserted within the housing 19 to rest at the opposite end to prevent the tip of the needle from penetrating to reach the housing itself.

A cap made of the same non-puncture resistant material as the housing 19 may likewise be used to accommodate the upper half of the syringe so that the entire syringe with attached needed is contained within confines of the housing 19 and the cap to prevent leaks of contents of the syringe from reaching areas of the pig beyond the housing. Such a cap and housing 19 serves the same role as a conventional sharps container, but would not be made from material that is puncture-resistant as is the sharps container and thus differs in that respect. The housing 19 and cap would be disposed of after use, but would serve the purpose of preventing contamination outside the housing and cap.

While the foregoing description and drawings represent the preferred embodiments of the present invention, it will be understood that various changes and modifications may be made without departing from the scope of the present invention.

What is claimed is:

1. An apparatus suited to transport radiopharmaceuticals, comprising:

a radiopharmaceutical pig with two halves each defining a respective cavity and being secured together so that the respective cavities together form a closed chamber, each of the two halves including a respective lead shield each with a surface; and encapsulating material arranged to encapsulate and seal the surface of at least one of the two lead shields to define a portion of the closed chamber by bounding same, the closed chamber being configured to accommodate a radiopharmaceutical syringe; and at least one housing within the closed chamber, the housing being formed of a non-puncture resistant material that is configured to give way to puncturing in response to driving of a tip of an attached needle of the radiopharmaceutical syringe under manual forces into the housing, the housing being elongated and configured to be open at one end and closed at an opposite end to define a space to accommodate insertion of the attached needle of the radiopharmaceutical syringe through the one end that is open so that a tip of the needle remains clear of the opposite end that is closed when flanges of the radiopharmaceutical syringe are held in position between the lead shields.

2. An apparatus of claim 1, wherein the closed chamber is configured to accommodate the radiopharmaceutical syringe with an attached needle, further comprising a radiopharmaceutical syringe with the attached needle being within confines of the closed chamber.

3. An apparatus of claim 1, further comprising at least one housing within the closed chamber, the housing being configured to accommodate insertion of a lower portion of the radiopharmaceutical syringe with attached needle through a mouth of the housing and into confines of the housing.

4. An apparatus of claim 1, wherein the encapsulating material encapsulates with securing material selected from a group consisting of ultrasonic weld material, heat seal material, adhering material, and laminating material.

5. An apparatus of claim 1, wherein the encapsulating material is secured in position to encapsulate the lead shields with mechanical fit components selected from a group consisting of screw locks, clamps, snap rings, pressure fit components and mechanical fasteners.

6. An apparatus of claim 1, wherein the radiopharmaceutical pig includes respective casings, each of the casings being secured to an outer facing surface of a respective one of the lead shields.

7. An apparatus of claim 6, wherein at least one of the casings and the encapsulating material are secured to each other with securing material selected from a group consisting of ultrasonic weld material, heat seal material, adhering material, and laminating material.

8. An apparatus of claim 6, wherein at least one of the casings and the encapsulating material are secured to each other with at least one mechanical fit component selected from a group consisting of screw locks, clamps, snap rings, pressure fit components and mechanical fasteners.

9. An apparatus of claim 1, wherein one of the two lead shields has an outwardly extending flange with a further surface that is clear of the closed chamber, the encapsulating material being arranged to encapsulate the further surface.

10. An apparatus of claim 1, wherein the two lead shields are elongated and each have edges that face each other, the edges being configured to overlap and engage each other to prevent radiation leakage.

11. An apparatus of claim 1, wherein the at least one lead shield has an outer facing surface that is likewise encapsulated by the encapsulating material and contiguous with the encapsulating material that encapsulates the surface that defines and bounds the portion of the closed chamber.

12. A method of assembly of an apparatus suited to transport pharmaceuticals, comprising:

encapsulating and sealing a surface of at least one lead shield of two halves of a radiopharmaceutical pig with encapsulating material, each of the halves defining a respective cavity; and bringing together the two halves of the radiopharmaceutical pig so that the respective cavities together form a closed chamber, the encapsulating material defining a portion of the closed chamber by bounding same, the closed chamber being configured to accommodate a radiopharmaceutical syringe; and arranging a housing within one of the two halves of the radiopharmaceutical pig and then carrying out the bringing of the two halves together so that the housing is within the closed chamber, the housing being formed of a non-puncture resistant material that is configured to give way to puncturing in response to a tip of an attached needle of the radiopharmaceutical syringe under manual forces being pressed against the housing, the housing being elongated and configured to be open at one end and closed at an opposite end to define a space to accommodate insertion of at least the attached needle of the radiopharmaceutical syringe through the one end that is open so that a tip of the needle remains clear of the opposite end that is closed when flanges of the radiopharmaceutical syringe are held in position between the lead shields.

13. A method of claim 12, wherein the closed chamber is configured to accommodate the radiopharmaceutical syringe with an attached needle, further comprising inserting the radiopharmaceutical syringe with attached needle into the cavity of one of the halves of the radiopharmaceutical pig before bringing the two halves together to form the closed chamber, the radiopharmaceutical syringe with attached needle being within the closed chamber after the two halves of the radiopharmaceutical pig are brought together.

14. A method of claim 12, comprising:

encapsulating an outer facing surface of the at least one lead shield with a casing; and securely attaching the encapsulating material and the casing to each other with a material selected from a group consisting of an ultrasonic weld seal, a heat seal, an adhering material, and a laminating material.

15. A method of claim 12, further comprising encapsulating an outer facing surface of the at least one lead shield with a casing; and securely attaching the encapsulating material and the respective casings to each other with at least one mechanical fit component selected from a group consisting of screw locks, clamps, snap rings, pressure fit components and mechanical fasteners.

16. A method of claim 12, wherein one of the lead shields has an outwardly extending flange with a further surface that is clear of the closed chamber, further comprising encapsulating the further surface with the encapsulating material.

17. A method of claim 12, further comprising carrying out the step of bringing the two halves of the radiopharmaceutical pig together while a housing is present in one of the two halves so that the housing is within the closed chamber after the two halves are brought together.

18. A method of claim 17, further comprising inserting the radiopharmaceutical syringe with an attached needle within confines of the housing prior to bringing the two halves of the radiopharmaceutical pig together.

19. An method of claim 12, further comprising encapsulating an outer facing surface of the at least one lead shield by the encapsulating material to be contiguous with the encapsulating material that encapsulates the surface that defines and bounds the portion of the closed chamber.

* * * * *